US005146944A

United States Patent [19]

Waldrum

[11] Patent Number: 5,146,944

[45] Date of Patent: Sep. 15, 1992

[54] DUAL PUMP METERING DILUTION APPARATUS

[75] Inventor: John E. Waldrum, Ambler, Pa.

[73] Assignee: DowElanco, Indianapolis, Ind.

[21] Appl. No.: 770,512

[22] Filed: Oct. 3, 1991

[51] Int. Cl.[5] ..... F04D 25/16

[52] U.S. Cl. ..... 137/99; 137/111

[58] Field of Search ..... 137/99, 87, 111, 112

[56] References Cited

U.S. PATENT DOCUMENTS

| | | | |
|---|---|---|---|
| 2,841,165 | 7/1958 | Emery | 137/99 |
| 3,498,310 | 3/1970 | Hechler | 137/99 |
| 3,650,286 | 3/1972 | Armstrong | 137/99 X |
| 4,529,000 | 7/1985 | Funk | 137/99 |

*Primary Examiner*—Alan Cohan

*Attorney, Agent, or Firm*—Alice A. Brewer

[57] ABSTRACT

Apparatus for dilution of one liquid with another, such as a pesticide concentrate diluted with water, wherein dual piston displacement pumps are each actuated respectively by a coil spring and by an opposed hydraulic actuator with a piston powered by the flow of the diluting liquid, the hydraulic actuator being controlled by a control means for alternating reciprocation of the respective pistons of each hydraulic actuator responsive to the rate of flow of the diluting liquid so that a constant dilution ratio is maintained regardless of the pressure of the liquid supply. The control means includes a vane that is pivoted alternately by the action of the hydraulic actuator pistons to direct the flow thereto of liquid for dilution.

18 Claims, 5 Drawing Sheets

DUAL PUMP METERING DILUTION APPARATUS

FIELD OF THE INVENTION

The invention relates to apparatus for dilution of one liquid by another, such as a pesticide concentrate diluted by water, in a predetermined accurately controlled proportion and to a dual piston actuator therefor.

BACKGROUND OF THE INVENTION

Various apparatuses have been used to dilute pesticidal concentrates such as hose sprayers widely used by home owners, using the water supply from a residential water spigot. However, so far as it is known, such devices have no provision for drawing continuously from a concentrate supply of more than a pint or so in volume nor of varying the rate of dilution once a pre-mix or the concentrate per se is placed in the hose sprayer container. In other spray devices a tank mix is made up and sprayed and the concentrate is used only for initially preparing the tank mix to be applied.

SUMMARY OF THE INVENTION

The present invention is directed to a dual pump metering dilution apparatus having a longitudinal conduit with an inlet at the rear with a control valve therefor and a discharge at the forward end and piston displacement pumps on opposite sides thereof adjacent the forward end to feed into the conduit, alternatingly, liquid to be diluted by liquid traversing the conduit. If desired, a control valve may be utilized at the discharge end, or in tubular delivery means connected thereto. The dual pumps are operable in a manner to achieve an accurate dilution at a predetermined dilution ratio regardless of the flow rate of the diluting liquid. This is achieved in the present apparatus using dual hydraulic activators each with a piston powered in turn by the flow of diluting liquid and a control means for alternating reciprocation of the respective pistons of each actuator means. The hydraulic activator means are mounted on the opposite sides of the conduit and each operatively aligned adjacent and behind a piston displacement pump so as to be in position to force the piston of the pump into its bore when the piston of the hydraulic actuator moves forwardly out of its bore under pressure from the diluting liquid. The control means is adapted to be triggered to divert the hydraulic pressure of the diluting liquid to the opposite hydraulic actuator means when a piston of the actuator means has reached a maximum stroke position, and, the advance of the opposite actuator piston by connecting pivoting lever means, pushes the first piston back into its bore, retracting the first piston from pressing against the piston of the displacement pump ahead of it. Coiled spring means within the bore of each displacement pump is adapted to force the piston thereof outwardly of its bore, drawing into the bore, from a supply source, liquid to be diluted.

It is preferred that the apparatus includes means for by-passing flow of diluting liquid past the control means and further that the extent of by-pass volume, and thus the dilution ratio, be adjustable.

The dual piston hydraulic actuator that is powered by liquid for dilution, together with the control means therefor, is also novel.

The apparatus is especially useful for injecting a pesticide into the soil or through a masonry slab or into masonry crevices upon attaching an appropriate cylindrical tube or other extension to the forward or discharge end of the longitudinal conduit. The apparatus is also useful when equipped with a spray nozzle for spraying directly from the apparatus or from a hose connected to the discharge end, e.g., from a spray rig. The apparatus is also useful in chemigation operations.

DETAILED DESCRIPTION OF THE INVENTION

Figure 1:
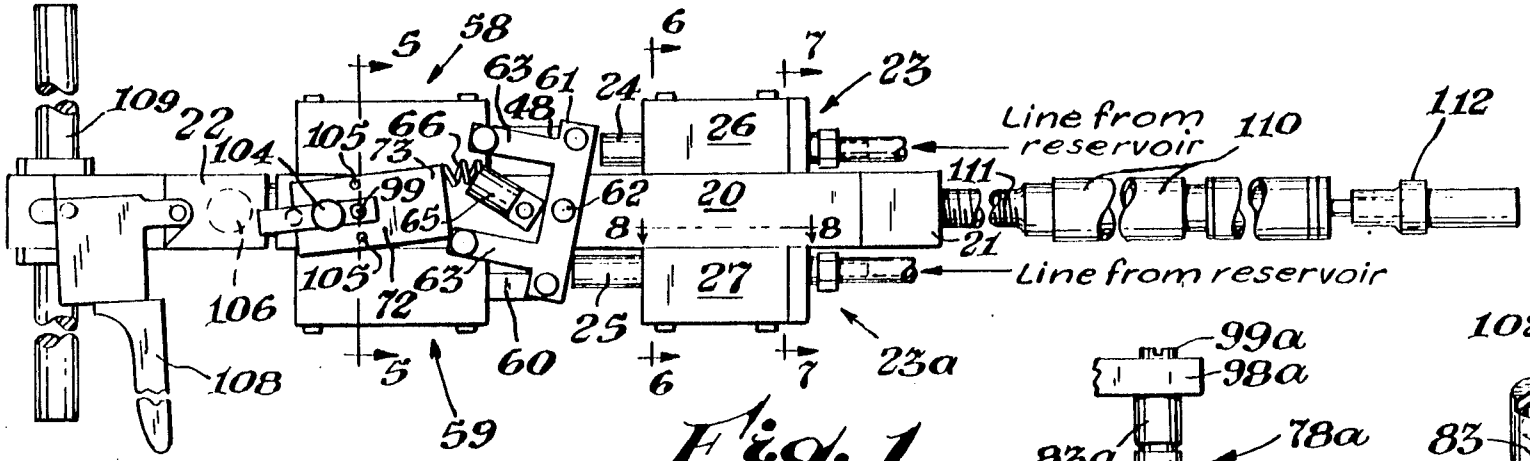
FIG. 1 is a view in front elevation of the dual pump metering apparatus of the invention, broken at several points in order to foreshorten the view to meet space limitations on the sheet.
Figure 2:
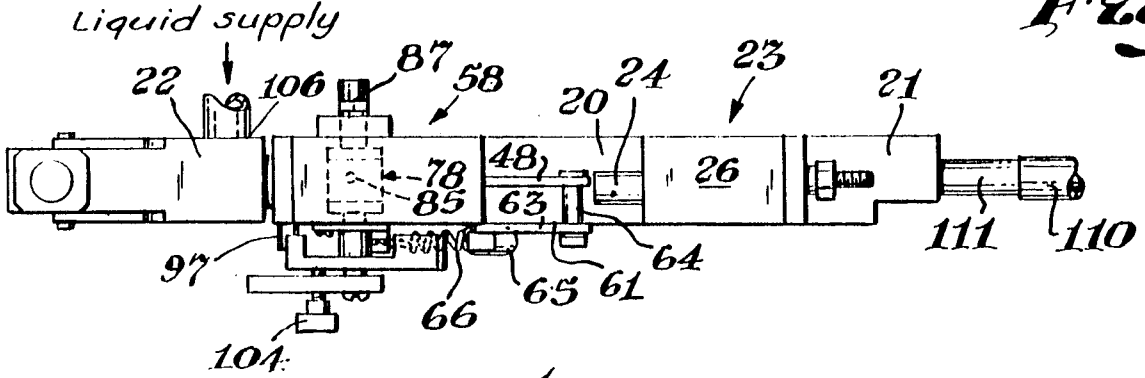
FIG. 2 is a partial plan view of the apparatus of FIG. 1 with the delivery end omitted from the view.
Figures 3, 15, 16, 17:
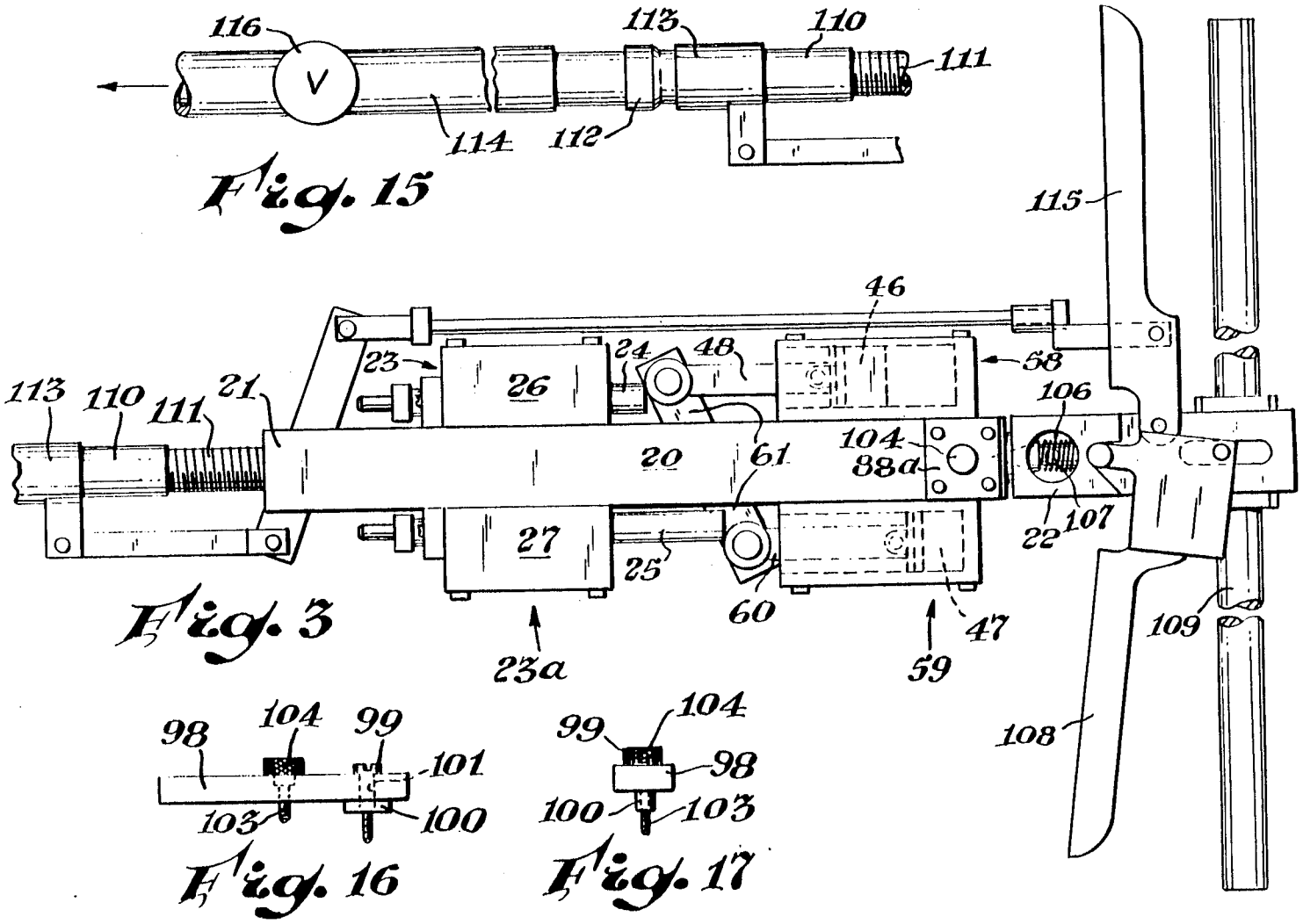
FIG. 3 is a bottom view of the apparatus of FIG. 1 showing optional added provisions for advancing and retracting a metal sleeve surrounding tubular delivery means near the discharge end of the apparatus to unroll any cuff formed by rolling up of the foreshortened rubber sleeve seen in FIG. 1.
FIG. 15 is an enlarged fragmentary view of the largely omitted discharge end of the apparatus of FIG. 3 showing the mechanism for unrolling any cuff formed on the short rubber sleeve, as well as an optional flexible hose or other tubular extension with a control valve for controlling the operation of the apparatus indicated schematically.
FIG. 16 is an enlarged side view of the locking mechanism used atop the pivotal cage for stopping the operation of the hydraulic actuator.
FIG. 17 is an end view of the locking device shown in FIG. 16.

As seen in FIGS. 1, 2 and 3 the dual pump metering dilution apparatus of the invention consists mainly of a longitudinal conduit 20 with a discharge end 21 at the front and an inlet end 22 at the rear for liquid for dilution, and a pair of piston displacement pumps 23 and 23*a* adjacent the discharge end 21, the pistons 24,25 of which are actuated by hydraulic means, indicated generally by the numerals 58 and 59 and adapted to utilize diluting liquid flowing through the conduit 20 from about the rear end 22 thereof for continuously alternatingly powering the pistons 24,25 of the positive displacement pumps 23,23*a* at an adjustable rate directly proportional to the rate of flow of the diluting liquid traversing the longitudinal conduit 20, and delivering liquid to be diluted at a predetermined or adjustable dilution ratio to diluting liquid traversing the conduit.

Figure 4:
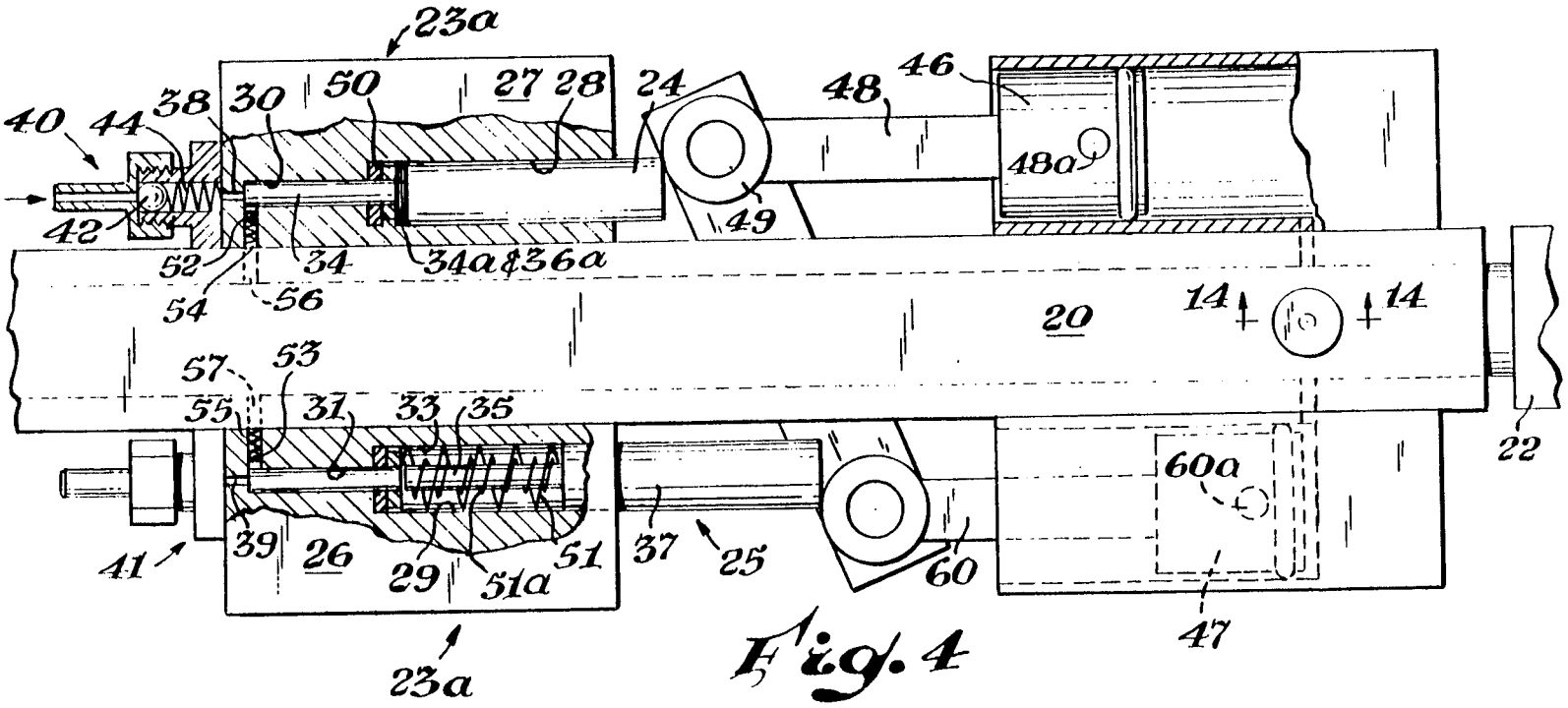
FIG. 4 is an enlarged fragmentary view in rear elevation partly broken away and in section, of the dual actuator piston drive and dual piston displacement pump section of the apparatus of FIG. 3, omitting the tubular delivery means and the added provision for unrolling any cuff formed of the rubber sleeve.

Further, as shown in FIGS. 1, 2 and 3 and particularly in the enlarged rear elevation view seen in FIG. 4, the piston displacement pumps 23,23*a*, as shown by sectioning the normally directly oppositely-placed pumps, are each formed with a body block 26,27 in which is bored a two-stage cylinder bore 28,29 with a smaller diameter forward portion 30,31 and a larger rearward portion 32,33 in which the two-stage pistons 24,25 respectively reciprocate. Each two-stage piston 24,25 likewise has a smaller diameter forward portion 34,35 and a larger diameter rear portion 36,37 complementary to the two-stage bores 28,29. In each case a small inlet bore or passageway 38,39 leads from an inlet connector fitting 40,41 in which is held a ball check valve 42,43 and coil spring 44,45. Valve 43 and spring 45 are not shown.

The smaller portion 34,35 of the pistons 24,25 reciprocate mainly in the smaller bore sections 30,31, the pistons retracting sufficiently to allow filling of much of the larger bore. As shown in FIG. 4, the larger coil spring 51 and the smaller coil spring 51*a* concentrically surrounding the smaller piston portion 35 of displacement pump 23*a* pushes or retracts the piston 25 when the associated actuator piston 47 is forced back into its bore by the other cooperating actuator piston 46 advancing. The advancing actuator piston 46 is shown in FIG. 4 at maximum outward stroke with the projecting connecting rod 48 and its end 49 pressed against the larger piston portion 36 of the piston displacement pump 23, compressing concentric coil springs 36*a* and 34*a* against seat 50. Coil springs 36*a* and 34*a* correspond to coil springs 51 and 51*a* when not compressed. Connecting rod 48 is attached to actuator piston 46 by wrist pin 48*a*.

With activator piston 47 forced back into its bore, coil springs 51 and 51*a* are shown as having forced the larger diameter portion 37 of piston 25 outwardly in its bore 33 so that the smaller diameter piston portion 35 is withdrawn from the smaller diameter bore portion 31, in such position that liquid drawn in through the small inlet bore 39 can fill the larger diameter bore 33 up to the larger piston portion 37. In this configuration, ball check valve 43 (not shown) is open while closed is the ball check valve 53 in the port 55 connecting the smaller bore portion 31 to the conduit inlet 57. Disposed around the smaller piston portion 35 and within the larger coil spring 51 is a smaller diameter coil spring 51*a* that helps to force the piston to retract and also serves as a guide to direct the smaller piston portion 35 back into the forward smaller bore 31 when the piston 25 reciprocates.

The configuration for the other piston displacement pump 24 has the ball check valve 42 closed to prevent return to supply of liquid to be diluted while ball check valve 52 leading through the port 54 to the conduit inlet 56 is open.

Figure 9:
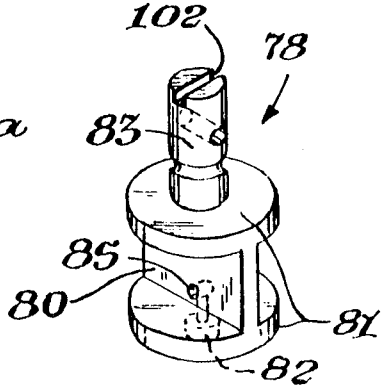
FIG. 9 is an isometric view, somewhat enlarged, of a suitable type of oscillating vane employed in powering and controlling the actuator pistons.
Figure 10:
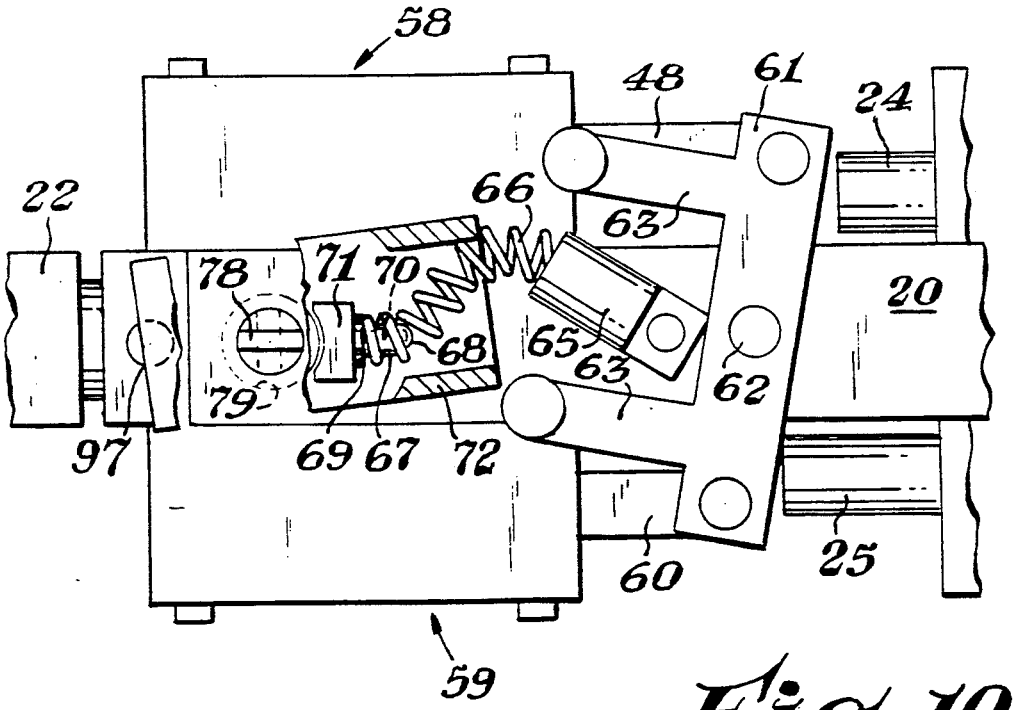
FIG. 10 is a fragmentary view of the apparatus of FIG. 1, greatly enlarged and partly broken away and in section, showing the activating mechanism for oscillating the vane controlling the powering of the dual actuator pistons.

The operation of the hydraulic actuators and the control means therefor will be better understood with reference to FIGS. 1, 2 and 10, in addition to FIGS. 4–9 and 11–14.

As seen in FIGS. 1, 2 and 10, the connecting rods 48 and 60 of the hydraulic actuators are interconnected by a bridging structure consisting of a generally $\pi$-shaped pivotable lever arm 61 attached centrally and pivotably to the conduit 20 by a screw or bolt 62, preferably surrounded by a bushing to give some sleeve bearing action, with legs 63, each leg extending at about a right angle to the lever arm itself and towards the rear of the apparatus and above the conduit 20. As seen particularly in FIG. 2, rod member 64, extending therefrom at an angle of about 90°, connects the lever arm 61, adjacent an end, with connecting rod 48, the ends of the interconnecting rod member 64 being journalled in or otherwise rotatably fastened to the lever arm 61 atop the conduit 20 as well as to the connecting rod 48, beside the conduit. The other end of lever arm 61 and the connecting rod 60 are similarly connected by a rod member (not shown). Extending from about the rear lateral edge of the lever arm 61 at about the pivot point of the bolt 62 is a short cylindrical sleeve 65 mounted by one end pivotably on the surface of the conduit 20 so as to be pivotable along the said surface. One end of a moderately stiff coil spring 66 is positioned inside the cylindrical sleeve 65. The other end of the coil spring 66 is projected or slipped over a short, ferrule-like element 67 having one end 68 closed and the other end outwardly flared as a flange 69, the flange diameter being at least as great as the diameter of the coil spring 66. The ferrule-like element 67 is slipped over a retaining pin 70 that extends fixedly from a small somewhat block-shaped support 71 mounted on the surface of the conduit 20, the retaining pin 70 extending approximately parallel to the conduit surface and adjacent thereto in the direction of the pivot point of the lever arm 61. The retaining pin 70 and the cylindrical sleeve 65 are sufficiently closely spaced relative to the length of the stiff coil spring 66 that the spring is compressed and bent at an included angle of about 95 to 120 degrees, preferably about 95 to about 110 degrees between its ends, and is of sufficient length that when the lever arm 61 is pivoted back and forth to the extent of movement had with full strokes of the actuator pistons, the coil spring 66, urged by the closest laterally adjacent leg 63 of the lever arm, exhibits a crisp, abrupt snap action as the compressed spring jerks rather suddenly from one side to recurve oppositely at the other side at about maximum pivotal movement of the lever arm 61.

Figure 13:
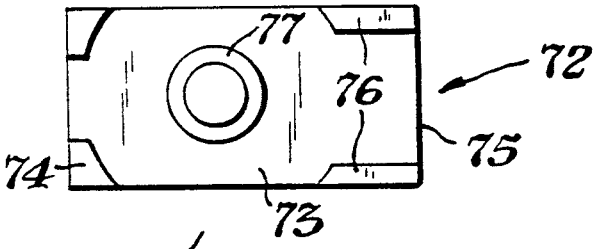
FIG. 13 is a bottom view of the pivotal cage.
Figure 12:
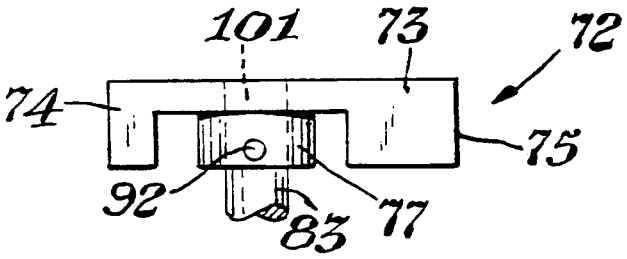
FIG. 12 is a side view of the pivotal cage that oscillates the oscillating vane, as mounted on the end of the axial shaft of the vane.

Surrounding about one-half to a little more than one-half the length of the coil spring 66, measuring from the end slipped over the ferrule-like element 67 is an inverted rectangular box-like pivotal cage member 72, that has a top wall 73 as the "bottom of the box", a rearward interrupted wall 74, an opposite open end 75, and partial longitudinal side walls 76, as seen more particularly in FIGS. 12 and 13. Further, extending downwardly from about the middle of the top wall 73 is an integrally formed hollow cylindrical portion 77 open at its distal end to receive the top end of the shaft 83 of the vane 78 of the liquid flow director means.

As seen in FIG. 10, the connecting rod 48 of the hydraulic actuator means 58 on that side has just been thrust forward to about maximum stroke, pivoting lever arm 61 sufficiently that one of the legs 63, the lower in the view, has just nudged the coil spring 66 enough to make it flip across to the alternate recurved configuration snapping and pivoting the box-like cage member 72 and consequently the vane 78 within the conduit to direct liquid flow to the piston of the other hydraulic actuator that will promptly advance connecting rod 60.

Figure 11:
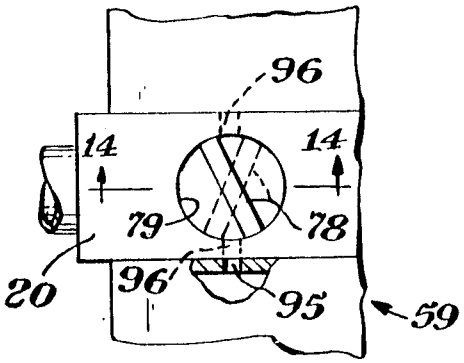
FIG. 11 is a fragmentary view based on FIG. 1 and greatly enlarged and partly broken away and in section showing the oscillating vane in alternate positions in its cylindrical cavity and the relationship of the vane to the slots in opposing sides of the sidewall of the cylindrical cavity in which the vane oscillates, as well as the connecting ports (inlets/outlets) to the laterally adjacent dual actuator pistons.
Figure 6:
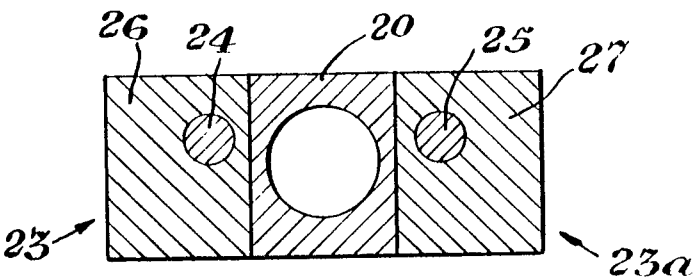
FIG. 6 is a view in section taken along line 6—6 of FIG. 1 and rotated 90 degrees counter-clockwise showing the relationship of the displacement pump pistons and the bore of the longitudinal conduit.
Figure 8:
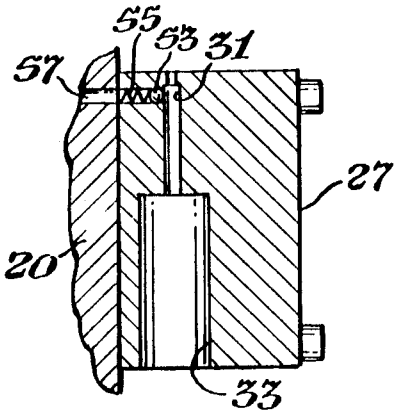
FIG. 8 is a view in section of a fragmentary portion of FIG. 1 taken along the line 8—8 showing the detail in one of the cylinder blocks of the larger and smaller connecting cylinder bores, i.e., compound bore, and the even smaller inlet passageway leading to the smaller cylinder bore, all in addition to the lateral discharge port that communicates with an inlet in the wall of the longitudinal conduit.
Figure 7:
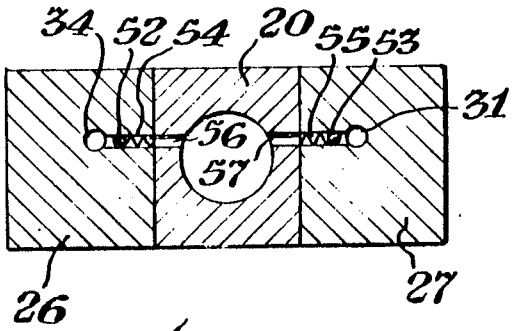
FIG. 7 is a view in section taken along line 7—7 of FIG. 1 and rotated 90 degrees counter-clockwise showing the respective boreholes in the dual piston displacement pump cylinder blocks and the longitudinal conduit and the communicating ports and inlets to the bore of the longitudinal conduit.
Figure 5:
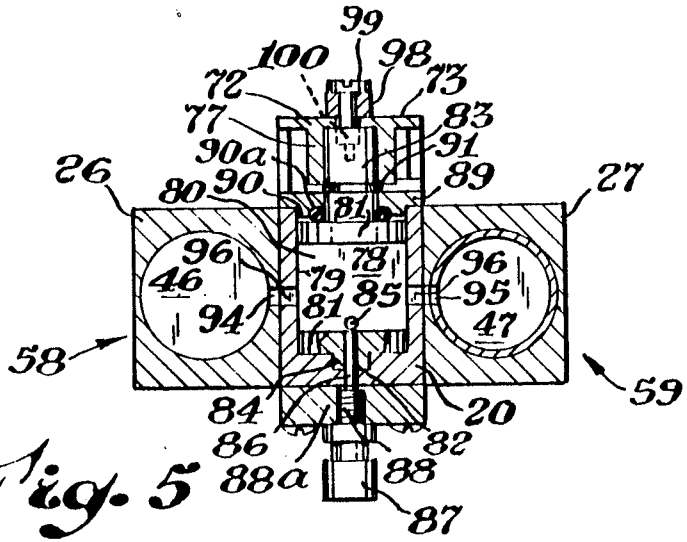
FIG. 5 is a view in section taken along the line 5—5 of FIG. 1 and rotated 90 degrees counter-clockwise showing the dual actuator pistons, and oscillating vane of the control means therefor.

Referring now more particularly to FIG. 4 again, together with FIGS. 3, 5 and 11, on either side of conduit 20 adjacent the pivotal cage member 72 are the hydraulic actuator means 58 and 59 powered and controlled by liquid flow director means to alternatingly reciprocate the actuator pistons 46,47 powered by the flow of liquid for dilution. The liquid flow director is a vane 78 disposed transversely to the direction of liquid flow through the conduit bore. The vane 78 is pivotal within a cylindrical cavity or bore 79 that intersects and is slightly larger in diameter than that of the conduit bore. Bore 79 need not be exactly cylindrical, it being sufficient that the lower portion thereof be defined by inner walls that are circular in section and complementary to the volume configuration swept out by the pivotal vane, and larger in diameter at all levels than a chord drawn across the conduit bore at that level.

The vane 78 preferably is constructed as shown in FIG. 9 and of durable polymeric material such as nylon, but preferably of brass, although other materials of construction may be dictated by the nature of the liquid for dilution to be used. The vane shown in FIG. 9 is also shown in FIG. 5 as installed. The vane 78 consists of a substantially rectangular planar central portion 80 and top and bottom flat circular guide portions or flanges 81 formed along the respective top and bottom sides of the rectangular vane portion.

As seen more particularly in FIG. 5, the guide portions 81 preferably rotate smoothly and closely within the bore 79 provided for the vane. The vane 78 also has axial shaft extensions or hubs 82 and 83 that extend from the circular guide portions 81. Foreshortened hub 82 extends into a complementary pocket or recess 84 formed therefor in the bottom of the bore 79 for the vane.

Vane 78 is preferably perforated with a relatively small hole 85 therethrough the flat planar portion to permit an additional, albeit steady, flow of liquid for dilution in addition to that which gets past the vane in the powering of the hydraulic actuator pistons 46,47. The small hole 85 must be appropriately sized, as will be understood by those skilled to permit an appropriate amount of liquid for dilution to pass through to get a preselected dilution ratio relative to the liquid supplied by the piston displacement pumps. Some liquid for dilution also passes through the conduit after discharge from the hydraulic actuators. More preferably, the perforation 85 is a slot that may be partly or nearly closed as by insertion from the bottom of vane hub 82 of a small close-fitting cylindrical rod or shaft 86 that is an extension of a small thumb screw 87 that may be threadably advanced or retracted within a tapped bore 88 in lower cover plate 88*a* attached to conduit 20 to adjust the dilution ratio obtained between the liquid for dilution and the liquid to be diluted by the apparatus.

The vane 78 is held in place by a cover plate 89 with a central opening therein so that the cover plate fits down around the upper hub 83. A circular boss or ring portion 90 on the under side of the cover plate 89 fits closely into the top of the bore 79 for the vane while the outer periphery of the cover plate 89 serves as a flange resting on top of conduit 20. Preferably an O-ring 90*a* is fitted around the hub 83 and within the circular boss portion 90 to provide a sealing closure of the bore 79 for the vane 78.

The hub 83 of the vane 78 is also provided with a peripheral slot into which a retaining ring 91 is snapped just above the cover plate 89 to assure a seal at the O-ring closure.

The upper hub 83 of the vane 78 extends above the conduit 20 and it is upon hub 83 that the box-like pivotable cage member 72 is mounted with the integrally formed hollow cylindrical portion 77 extending down from the upper wall 73 of the cage member 72 slipped over the hub 83 and affixed thereto with a pin 92 extending transversely through the cylindrical portion 77 and the hub 83 within it through aligned apertures therefor. Any movements of the pivotal cage member 72 are thus transmitted directly to the vane 78. If desired, means may be provided in the way of stops to control maximum pivotal movement of the cage member 72 and thus the vane 78, such as a post 97 seen in FIG. 2 extending up from the surface of the conduit 20 between the partial sidewalls 76 of the box-like cage member 72. A range of movement of the vane 78 similar to that depicted in FIG. 11 has been found to be adequate, i.e., of the order of about 15 to about 25 degrees angular movement. Just enough angular movement to completely block and unblock each opposed slot 96 cyclically in turn is all that is needed.

Figure 14:
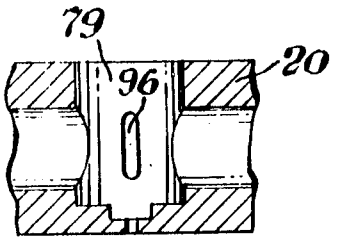
FIG. 14 is a fragmentary view in section of the control portion of the apparatus showing one side of the cylindrical chamber in which the vane operates, taken along the line 14—14 of FIG. 4 with all superstructure and the vane omitted for the purposes of illustration.

The generally opposed slots 96 in the sidewall, of the bore 79 for the vane 78, that each serve as part of the inlet/outlet for each hydraulic means, are preferably diametrically opposed and each about on a line between the axis of rotation of the vane and one of the respective inlet/outlet ports 94,95 of the adjacent hydraulic actuators. For example, the slot 96 appearing in the enlarged fragmentary sectional view of FIG. 14 is substantially in the plane of the vane 78 when the vane is turned to extend directly transversely across the bore of the conduit 20.

During operations with the present apparatus the vane 78 needs to oscillate or pivot back and forth with a continuous series of abrupt snapping actions, each time reversing through an angle of about 15 to about 25 degrees of rotation of the vane, first blocking liquid flow and pressure from upstream to one slot 96 consequently allowing pressure relief and backflow downstream, while at the same time allowing liquid flow and transmission of hydraulic pressure from upstream through the opposite slot 96 to the hydraulic actuator it supplies, and then the converse for both slots when the vane 78 is pivoted back to unblock the first slot and block the second from flow from upstream.

When one of the actuator pistons moves forward, it pivots the lever arm 61 forcing the other actuator piston back into its bore. In so doing, the retracting actuator piston forces the liquid in the cylinder back out through the inlet/outlet 94 or 95 and the adjacent slot 96 through which the liquid had entered, while the vane is turned or pivoted so that the discharged liquid is on the downstream side of the vane 78, and is swept along with liquid for dilution passing through the perforation 85 in the vane.

If desired, the box-like pivotable cage member 72 may be locked into a fixed position so that the hydraulic actuators receive no driving liquid mutually exclusively and are static and thus nothing is drawn in by the piston displacement pumps. In that case only liquid for dilution passes through the apparatus, e.g., for rinsing operations, and no liquid to be diluted is drawn in by the piston displacement pumps. The lock or stop may take the form of a small metal strip 98, seen in FIGS. 16 and 17 in isolated views, strip 98 being attached atop the box-like cage member 72 by machine screw 99. The metal strip 98 has a rectangular solid-shaped boss portion 100 on its underside at one end of the strip. The boss portion 100 slides into and through an aperture 101 in the top wall of the cage member 72 and is received in a complementary-shaped slot 102 in the end of the hub 83 of the vane 78 as seen in FIG. 9. The floor of the slot 102 is drilled and tapped to threadably receive the machine screw 99.

The metal strip 98 is also drilled and tapped at about mid-length, or optionally further, from the attached end and a machine bolt or screw 103, with a knurled knob 104 for convenience of use, is threaded into and through the tapped hole to reach the surface of the cage member 72. Two or more concavities 105 as seen in FIG. 1 are countered into the surface of the top wall 73 of the cage member 72, each at equal radial distances from the pivot point at machine screw 99. One of the concavities 105 is located with respect to the relative angular rotational disposition of the slot 102 seen in FIG. 9 and the planar portion 80 of the vane 78 such that the vane will move past each inlet/outlet slot 96 in each complete half cycle of the operation of the hydraulic actuators, the vane pivoting the requisite 15 to 25 degrees one way and then the other, alternately blocking and unblocking the inlet/outlet slots, respectively, from the flow of liquid for dilution. The midline plane of the slot 102 in the hub 83 of the vane will be, angularly, about 90 degrees from the plane of the planar portion 80 of the vane 78.

Upon releasing the metal strip 98 from locking engagement with the cage member 72 by loosening the thumbscrew 103 and retracting it from the operative position, ordinarily at the longitudinal midline of the top wall 73 of the cage member 72 and swinging the metal strip 98 about 25 to about 35 degrees in either direction and turning the thumbscrew down into another concavity 105 located at that position, the vane 78 is locked in a position by the cage member 72 such that no oscillation or pivoting of the vane is possible and all hydraulic actuator action stops and no more pumping action by the piston displacement pumps occurs, until and unless the metal strip 98 is moved back into the operative configuration in which the vane 78 can move in the correct range of angular oscillations.

Figure 18:
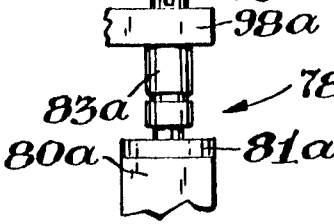
FIG. 18 is a fragmentary side view of another form of the oscillating vane shown in FIG. 9.

Upon employing a modification of vane 78, such as vane **78*a* as seen in FIG. 18, together with a modified metal strip 98*a* there shown in fragmentary view, hydraulic actuator action can be halted by simply loosening setscrew 99*a* to disconnect the vane 78*a* from any pivotal action of the cage member 72. With no driving force to pivot the vane from side to side there is nothing to relieve the pressure upon an actuator piston once driven forward and the vane can simply assume the rotational angle with least resistance to the flow of liquid for dilution, ordinarily with the planar portion 80*a* parallel with the direction of liquid flow. The hub 83*a* of vane 78*a* is made with no slot at the end, but simply with a tapped hole for threadably receiving setscrew 99*a*. Setscrew 99*a* extends through an aperture in the metal strip 98*a* near the end of the strip and into the end of hub 83*a*. With liquid for dilution 10 flowing through conduit 20 and forcing vane 78*a* into a position of minimal resistance to liquid flow, the plane of vane 78*a* should be oriented directly in the direction of liquid flow. The vane 78*a* can then be turned 90 degrees and with the metal strip 98*a* and cage member 72 both turned in the direction of the longitudinal axis of conduit 20, the setscrew 99*a* can be tightened snugly to hold the vane 78*a* substantially in the correct orientation with respect to cage member 72** for proper operation of the hydraulic actuators.

Flow of liquid for dilution is admitted to the rear or inlet end 22 of conduit 20 through an inlet port 106 controlled by a conventional inlet valve 107 that is manipulated conveniently by a pivotal lever arm 108 of most any commonly known design and function.

In order to conveniently handle the present apparatus it is desirable to have a handle such as handle 109 fixedly attached to the rear or inlet end 22 of conduit 20, the handle extending transversely so that left and right hand portions can be grasped by both hands. With a spring loaded lever that can be squeezed to turn on the liquid supply or released to permit the valve to be shut off by the spring, the apparatus is readily and easily operated.

Wherein the apparatus is used for injection of a pesticidal material such as chlorpyrifos, e.g., for the purpose of termite control, the discharge end of conduit 20 may take the form of a tubular extension 110 threadably attached to the conduit with a pipe nipple 111 as seen in FIGS. 1 and 15, and if desired, terminating in a smaller diameter delivery tube with a rubber sleeve 112 adjacent the distal end to minimize leakage when injection is being made into the ground or into holes bored in masonry walls or floors, and the delivery tube end is pressed against the injection hole or site. Because such rubber sleeve is wont to roll into a cuff it is desirable to have lever means such as that shown in FIGS. 3 and 15 for advancing a metal sleeve 113 closely fitting the delivery tube and behind the rubber sleeve 112 to unroll any cuff that may roll back and form during forcing of the delivery tube into a close fitting hole for injection.

It may be desirable in some uses of the apparatus of the invention to attach a flexible hose or tube at the output or discharge end 21 or extension thereof, such as the tube 114 indicated schematically in FIG. 15 and to place a valve 116 in line in such tube or hose in order to control the operation of the apparatus remotely at the output end of the hose or tube. The operation of the apparatus can be controlled either at outlet valve 116 or at the inlet valve 107.

Among the advantages of the invention are (1) that pesticide concentrate may be used for pesticide application without need for the applicator to be exposed to the concentrate as in making up a tank mix as the concentrate is drawn in accurately and made into final dilution, and (2) the present apparatus may utilize residential water supply of various pressures without alteration of the dilution ratio so a pest control operator can readily use the apparatus at the customer's residence.

What is claimed is:

1. A dual pump metering dilution apparatus comprising:

a longitudinal conduit with a sidewall, a rear end, and a forward discharge end, the conduit having an inlet at about the rear end for liquid for dilution:

dual piston displacement pumps mounted one on either side of the conduit, each pump having an inlet for liquid to be diluted and a discharge port leading to an inlet through the sidewall of the conduit: and respective hydraulic piston means adapted to utilize liquid for dilution flowing through the conduit from about the rear end thereof for continuously alternatingly and mutually exclusively powering the respective pistons of the displacement pumps at a rate directly proportional to the rate of flow of the diluting liquid traversing the longitudinal conduit.

2. A dual pump metering dilution apparatus comprising:

a longitudinal conduit having a continuous longitudinal bore surrounded by a defining wall, and a forward end and a rearward end and an intermediate portion:

a pair of piston displacement pumps positioned respectively at substantially opposite sides of the intermediate portion of the conduit, each pump having a cylindrical bore in which a piston is positioned and is reciprocable substantially parallel to the conduit, each pump having a forward inlet leading to the cylindrical bore thereof and a laterally directed discharge port from the forward end of the cylindrical bore to an inlet in the conduit wall communicating with the longitudinal bore:

first and second hydraulically reciprocable actuator pistons and cylinders therefor positioned at substantially opposite sides of the conduit and each actuator piston being substantially aligned with and operatively adjacent rearwardly of a respective piston of a displacement pump, hydraulic control means adapted for alternately and successively hydraulically powering the respective reciprocable actuator pistons utilizing liquid for dilution under pressure moving through the conduit to cause cyclical reciprocations of each piston from a rearward to a forward position, the hydraulic control means providing cyclical communication between the bore of the conduit and the respective hydraulically reciprocable pistons and having lever means associated with each such piston and the conduit:

valve means for controlling the flow of liquid through the apparatus:

the actuator pistons being reciprocable at a rate adjustably proportional to the volume of liquid flowed through the longitudinal conduit: and means for by-passing flow of a pre-selected proportion of liquid for dilution past the hydraulic control means and through the longitudinal bore of the conduit.

3. The metering dilution apparatus of claim 2 having, in addition, hollow tubing connecting the inlet of each piston displacement pump with a container for a liquid to be diluted by liquid for dilution supplied to the bore of the conduit adjacent the rearward end thereof.

4. The metering dilution apparatus of claim 2 wherein each piston displacement pump is provided with coil spring means inside the cylinder thereof, the coil spring means being adapted to urge the piston to a retracted position in coordination with rearward movement of the hydraulically reciprocable actuator piston aligned therewith.

5. The metering dilution apparatus of claim 3 wherein the inlet of each displacement pump is connected by a liquid supply line to a source of liquid pesticide concentrate.

6. The metering dilution apparatus of claim 2 in which the cylinder for each of the first and second hydraulically reciprocable actuator pistons comprises a body block with a rear closed end and a forward end into which a cylindrical bore extends, the reciprocable actuator pistons being reciprocable in the respective cylindrical bores to each extend out of the bore in sufficient alignment with one of the piston displacement pumps to actuate such pump by driving the piston thereof into the bore of the pump when the reciprocable actuator piston moves forward outwardly of its bore, the hydraulic control means comprising a chamber interrupting the continuous bore of the longitudinal conduit, the chamber being positioned between the body blocks of the reciprocable actuator pistons and having first and second inlet/outlet openings each communicating with a port leading to a cylindrical bore in which a piston reciprocates:

pivotal lever means mounted transversely externally of the longitudinal conduit and pivotable respectively and alternately by each actuator piston to urge the other actuator piston back into its bore:

a vane pivotable about a midline axis thereof disposed in said chamber and said chamber being substantially circular in section complementary to the volume swept out by the vane, said vane being pivotable in response to the movement of the lever means to a first position in which the vane directs liquid flowing from the rearward end of the longitudinal conduit to the first inlet/outlet opening of the chamber to power forwardly the associated reciprocable actuator piston in communication therewith while allowing relief of pressurized liquid out of the second inlet/outlet opening to the cylinder of the actuator piston on the other side of the longitudinal conduit and downstream of the vane, said lever means being pivotable at preselected maximum forward motion of the first actuator piston to cause the vane to pivot to a second position in which the vane directs liquid flowing from the rearward end of the longitudinal conduit to the second inlet/outlet opening of the chamber to, in turn, power forwardly the associated actuator piston in communication therewith while allowing relief of pressurized liquid out of the first inlet/outlet opening to the cylinder of the associated actuator piston on the other side of the longitudinal conduit and downstream of the now pivoted vane, said lever means being actuatable at preselected maximum forward motion of the second actuator piston to cause the vane to pivot back to said first position:

the cylindrical bore of each reciprocal actuator piston communicating respectively with said chamber only through a single port communicating with an inlet/outlet in the chamber wall and each such port being at respective sides of the chamber: and the vane being pivotable angularly in the opposite direction of the pivotal motion of the lever means.

7. The metering dilution apparatus of claim 6 in which means for pivoting the vane in response to the forward movement of a reciprocable piston includes spring means pivoting the vane oppositely from the direction of pivoted motion of the lever means.

8. The metering dilution apparatus of claim 7 in which the spring means is a coil spring means and is adapted to provide delayed snap action each time the pivoting lever means approaches a maximum predetermined position.

9. The metering dilution apparatus of claim 6 in which the means for by-passing flow of liquid past the hydraulic control means is a perforation extending through the vane.

10. The metering dilution apparatus of claim 9 in which the vane has a single perforation therethrough and the apparatus further includes means for adjusting the size of the perforation.

11. The metering dilution apparatus of claim 2 having additionally a cylindrical forward extension of the longitudinal conduit connected thereto and communicating therewith and having a distal end.

12. The metering dilution apparatus of claim 11 having a rubber sleeve snugly surrounding a portion of the cylindrical forward extension adjacent the distal end thereof.

13. The metering dilution apparatus of claim 11 having a foreshortened cylindrical metal sleeve surrounding a portion of the cylindrical forward extension between the longitudinal conduit and the rubber sleeve, the metal sleeve being reciprocable on the cylindrical forward extension and of sufficiently small diameter to forwardly unroll any cuff formed by the rubber sleeve: and compound lever means mounted on said apparatus for reciprocating the metal sleeve forwardly sufficiently to unroll any said cuff.

14. The apparatus of claim 1 further including a control valve to control the flow of liquid through the apparatus.

15. The apparatus of claim 1 wherein the control valve is located adjacent the inlet of the longitudinal conduit.

16. The apparatus of claim 1 further including tubular liquid delivery means connected at the discharge end and communicating therewith and a control valve in series with the tubular liquid delivery means.

17. Hydraulically operable and controllable dual actuator piston apparatus for alternatingly powering respective aligned dual displacement pumps which comprises:

a conduit with a longitudinal bore, a forward discharge end, a rearward inlet end and laterally opposed ports through the wall defining the bore:

dual hydraulic actuator pistons for alternatingly reciprocatingly driving respective dual piston displacement pumps:

hydraulic control means for operation of the hydraulic actuator pistons:

a pair of body blocks disposed on opposed sides of the conduit, each body block having a rear closed end and a forward end into which a cylindrical bore extends, and an inlet/outlet opening adjacent the closed end communicating with one of the ports to the bore of the conduit: and means for by-passing flow of liquid past the hydraulic control means and through the bore of the conduit:

each hydraulic actuator piston being reciprocatingly disposed in the cylinder of a body block:

the hydraulic control means being adapted for mutually alternately and successively powering the respective reciprocable actuator pistons utilizing a steady flow of liquid from the rearward end to the forward end of the conduit, the hydraulic control means providing cyclical communication between the bore of the conduit and the respective cylinders via said ports and inlet/outlet openings, and the hydraulic control means including liquid flow control means operable by a pivotal lever mounted on the conduit and connected to each actuator piston:

the actuator pistons being reciprocable at a rate adjustably proportional to the volume of liquid flowed through the bore of the conduit.

18. The hydraulically operable and controllable dual actuator piston apparatus of claim 17 in which:

the hydraulic control means includes a chamber interrupting the bore of the conduit, the chamber being positioned between the body blocks and the respective ports extending between the chamber and the inlet/outlet openings of the respective cylinders:

the pivotal lever being adapted to urge each actuator piston back into its cylinder when the other actuator piston is hydraulically urged out of its cylinder:

the hydraulic control means further including a vane pivotable about a midline axis thereof disposed in said chamber and said chamber being substantially circular in section complementary to the volume swept out by the vane, said vane being pivotable in response to the movements of the lever means to a first position in which the vane directs liquid flowing from the rearward end of the conduit to the first lateral port of the chamber to power forwardly the associated reciprocable actuator piston in communication therewith, while allowing relief of pressurized liquid out of the second lateral port communicating with the reciprocable actuator piston on the other side of the conduit allowing the liquid to discharge downstream of the vane;

the lever means being pivotable at preselected maximum forward motion of the first actuator piston to cause the vane to pivot to a second position in which the vane directs liquid flowing from the rearward end of the conduit to the second lateral port of the chamber to, in turn, power forwardly the associated actuator piston in communication therewith while allowing relief of pressurized liquid out of the first lateral port from the actuator piston on the other side of the conduit allowing the liquid to discharge downstream of the now-pivoted vane, said lever means being actuatable at a preselected maximum forward motion of the second actuator piston to cause the vane to pivot back to said first position wherefore the cycle repeats;

the cylindrical bore of each body block communicating respectively with said chamber only through a single inlet/outlet opening-port combination; and the vane being pivotable angularly in the opposite direction of the pivotal motion of the lever means.

* * * * *